United States Patent [19]

McClelland et al.

[11] 4,394,185

[45] Jul. 19, 1983

[54] PROCESSING FOR COPPER BERYLLIUM ALLOYS

[75] Inventors: Henry T. McClelland, Shoemakersville; Joseph B. Kuhn, Reading, both of Pa.

[73] Assignee: Cabot Berylco, Inc., Reading, Pa.

[21] Appl. No.: 363,682

[22] Filed: Mar. 30, 1982

[51] Int. Cl.[3] ..... C22F 1/08

[52] U.S. Cl. ..... 148/11.5 C; 148/12.7 C; 148/160

[58] Field of Search ..... 148/11.5 C, 12.7 C, 148/160

[56] References Cited

U.S. PATENT DOCUMENTS

| | | | |
|---|---|---|---|
| 1,974,839 | 9/1934 | Silliman | 148/160 |
| 2,257,708 | 9/1941 | Stott | 148/12.7 C |
| 2,412,447 | 12/1946 | Donachie | 148/160 |
| 3,138,493 | 6/1964 | Smith | 148/11.5 C |
| 3,196,006 | 4/1965 | Lane et al. | 75/153 |
| 3,536,540 | 11/1967 | Rauch | 148/13 |
| 3,753,696 | 8/1973 | Shibata et al. | 75/157.5 |
| 3,841,922 | 10/1974 | De Jarnett | 148/13.2 |
| 3,985,589 | 10/1976 | Shapiro et al. | 148/160 |
| 4,179,314 | 12/1979 | Wikle | 148/12.7 C |

FOREIGN PATENT DOCUMENTS

| | | | |
|---|---|---|---|
| 1359828 | 3/1964 | France | 148/11.5 C |

*Primary Examiner*—Peter K. Skiff

*Attorney, Agent, or Firm*—J. Schuman; Robert F. Dropkin

[57] ABSTRACT

A process for producing formed copper beryllium alloys. The process includes the steps of: preparing a copper beryllium melt; casting the melt; hot working the cast copper beryllium; solution annealing the copper beryllium; optionally cold working the solution annealed copper beryllium; forming the copper beryllium; and age hardening the formed copper beryllium; and the improvement comprising the step of preaging the solution annealed or solution annealed and cold worked copper beryllium, prior to forming, at a temperature of from 400° to 1000° F. for a period of up to 180 seconds, the copper beryllium being at final gauge prior to preaging.

7 Claims, No Drawings

PROCESSING FOR COPPER BERYLLIUM ALLOYS

The present invention relates to a process for producing formed parts from copper beryllium alloys.

Copper beryllium alloys are capable of being formed into intricate parts for connector applications. The highest formability is available, for a given temper, in the unaged condition. The best mechanical and electrical properties occur when the material has been age-hardened.

Stamping of connector parts from copper beryllium strip in the unaged condition followed by an age-hardening heat treatment would appear to be a desirable means for making use of the formability of the unaged strip while obtaining age-hardened properties for the formed parts. Such is not always the case. Part distortion is a problem. Parts distort during aging and do so in a nonuniform, unpredictable fashion.

Through the present invention there is provided a process by which distortion is reduced and rendered more uniform and predictable, and yet a process which provides producers of copper beryllium parts with material having good formability, and yet a process which does not materially detract from the properties of the formed parts. This desirable result is achieved through the use of a controlled preaging treatment prior to forming.

A number of references disclose processing for copper beryllium alloys. These references include U.S. Pat. Nos. 1,974,839; 2,257,708; 2,412,447; 3,138,493; 3,196,006; 3,536,540; 3,753,696; 3,841,922; 3,985,589; and 4,179,314. None of these references disclose the subject invention.

It is accordingly an object of the subject invention to provide a process for producing formed parts from copper beryllium alloys.

The present invention provides a process for producing formed parts from copper beryllium alloys. The process includes the steps of: preparing a copper beryllium melt; casting the melt; hot working the cast copper beryllium; solution annealing the copper beryllium; optionally cold working the solution annealed copper beryllium; forming the copper beryllium; and age hardening the formed copper beryllium; and the improvement comprising the step of preaging the solution annealed or solution annealed and cold worked copper beryllium, prior to forming, at a temperature of from 400° to 1000° F. for a period of up to 180 seconds, the copper beryllium being at final gauge prior to preaging. Hot and cold rolling, are respectively, the usual means of hot and cold working. Copper beryllium can be formed into any number of parts, including contacts, clips, clamps and connectors, for the electronics industry.

Preaging lessens the degree of distortion which occurs during aging and renders that which does occur, more uniform and predictable. It accomplishes this desired result without materially detracting from the alloys formability and without materially detracting from the properties of the formed part. Although the mechanism by which it accomplishes the desired result is not known for sure, it is hypothesised that it relieves residual stresses in the alloy.

Preaging is a time and temperature dependent process which is accomplished at a temperature of from 400° to 1000° F. for a period of 180 seconds or less. It is usually at a temperature of from 550° to 900° F. and is preferably at a temperature of from 650° to 850° F. It is usually for a period of 110 seconds or less and is preferably for a period of 90, or even 70, seconds or less. Time at temperature will usually be at least 5 seconds. Lower temperatures within the specified ranges will require longer times. Time at temperature should be sufficient to accomplish the desired result, which is hypothesised to be an easing of residual stresses. Higher temperatures within the specified ranges necessitate shorter times. Preaging can be difficult to control at the higher temperatures.

The steps of preparing a copper beryllium melt, casting the melt, hot working the cast alloy, solution annealing the alloy, cold working the alloy, forming the alloy and aging the formed alloy are not discussed in detail as they are well known to those skilled in the art and are discussed in many references including those cited herein. Solution annealing is generally at a temperature of at least 1300° F. for a period of at least 5 minutes. The solution annealed material is rapidly cooled from its annealing temperature. Aging is generally at a temperature of from 400° to 1200° F. for a period of at least 4 minutes. The desired level of properties dictate aging times and temperatures.

The subject invention is believed to be adaptable to a wide range of copper beryllium alloys. These alloys will generally contain from 0.2 to 3.0% beryllium, up to 3.5% of material from the group consisting of cobalt and nickel, and at least 90% copper. Other elements may be present for various purposes such as castability, machinability and grain refinement, or as incidental impurities.

The following examples are illustrative of several aspects of the invention.

EXAMPLE I

Samples of copper beryllium alloy were melted, cast, hot rolled, solution annealed, cold rolled, preaged and aged. They were in either the ½ H or H temper. Those in the ½ H temper had 1.82% beryllium and 0.25% cobalt. Their gauge was 0.015 inch. Those in the H temper had 1.81% beryllium and 0.25% cobalt. Their gauge was 0.008 inch. Samples for each temper were preaged at 800° F. and aged at 700° F., for time periods as shown hereinbelow in Table I.

TABLE I

| SAMPLE | PREAGE TIME (Seconds) | AGE TIME (Minutes) |
|---|---|---|
| 1-A | 10 | 2 |
| 1-B | 10 | 3 |
| 1-C | 10 | 4 |
| 1-D | 10 | 5 |
| 1-E | 10 | 6 |
| 1-F | 15 | 2 |
| 1-G | 15 | 3 |
| 1-H | 15 | 4 |
| 1-I | 15 | 5 |
| 1-J | 15 | 6 |
| 1-K | 30 | 2 |
| 1-L | 30 | 3 |
| 1-M | 30 | 4 |
| 1-N | 30 | 5 |
| 1-O | 30 | 6 |

The examples were tested for ultimate tensile strength, yield strength and elongation. The results are shown hereinbelow in Tables II and III. Table II is for the ½ H temper samples. Table III is for the H temper samples. All values are the average for two tests.

TABLE II

| SAMPLE (½ H Temper) | UTS (ksi) | YS (ksi) | ELONGATION (%) |
|---|---|---|---|
| 1-A | 151.3 | 132.9 | 12.5 |
| 1-B | 159.4 | 140.9 | 11.5 |
| 1-C | 165.0 | 146.4 | 9.5 |
| 1-D | 169.1 | 150.3 | 9.5 |
| 1-E | 171.3 | 153.0 | 10.0 |
| 1-F | 151.1 | 132.4 | 13.0 |
| 1-G | 159.3 | 140.8 | 11.0 |
| 1-H | 167.2 | 147.3 | 10.5 |
| 1-I | 171.7 | 153.9 | 10.5 |
| 1-J | 171.2 | 155.3 | 8.0 |
| 1-K | 152.9 | 131.0 | 12.5 |
| 1-L | 160.1 | 140.0 | 12.0 |
| 1-M | 164.0 | 145.1 | 11.5 |
| 1-N | 166.7 | 148.1 | 9.5 |
| 1-O | 167.8 | 147.9 | 10.0 |

TABLE III

| SAMPLE (H Temper) | UTS (ksi) | YS (ksi) | ELONGATION (%) |
|---|---|---|---|
| 1-A | 163.9 | 149.1 | 7.5 |
| 1-B | 169.7 | 153.4 | 5.0 |
| 1-C | 171.5 | 155.3 | 5.5 |
| 1-D | 173.5 | 157.7 | 5.0 |
| 1-E | 174.3 | 159.8 | 5.0 |
| 1-F | 165.1 | 148.9 | 5.5 |
| 1-G | 169.0 | 152.6 | 6.5 |
| 1-H | 171.6 | 154.4 | 5.5 |
| 1-I | 173.3 | 157.2 | 5.5 |
| 1-J | 175.4 | 157.2 | 5.0 |
| 1-K | 163.9 | 146.2 | 6.0 |
| 1-L | 165.3 | 147.3 | 6.5 |
| 1-M | 167.3 | 149.8 | 7.0 |
| 1-N | 169.7 | 152.7 | 6.5 |
| 1-O | 170.2 | 153.2 | 6.0 |

A comparison of the data from Tables II and III with that of established aging curves shows that the properties for the preaged and aged samples agree reasonably well with those established for samples which were not preaged, regardless of whether the samples were preaged for 10, 15 or 30 seconds. The short term preage of the subject invention does not materially detract from the aging characteristics of copper beryllium.

EXAMPLE II

Samples of copper beryllium alloy were melted, cast, hot rolled, solution annealed, preaged and aged. Some of the samples were cold rolled. They were in either the ¼ H, ½ H or H temper. The other samples were in the solution annealed (A) temper. Some of the samples had a beryllium content of from 1.81 to 1.89% and a cobalt content of from 0.21 to 0.24%. Their gauge was from 0.0049 to 0.0151 inch. The other samples had a beryllium content of from 1.73 to 1.79% and a cobalt content of from 0.19 to 0.23%. Their gauge was from 0.0050 to 0.0105 inch. Samples for each temper were preaged for 15 seconds and aged as shown hereinbelow in Tables IV and V. Tables IV and V also give the preaging temperature. Table IV is for those samples having from 1.81 to 1.89% beryllium. Table V is for those samples having from 1.73 to 1.79% beryllium.

TABLE IV

| SAMPLE (1.81 to 1.89% Be) | PREAGE TEMPERATURE (°F.) | AGE TEMPERATURE (°F.) | AGE TIME (Minutes) |
|---|---|---|---|
| 2-A | 700 | 700 | 4 |

TABLE IV-continued

| SAMPLE (1.81 to 1.89% Be) | PREAGE TEMPERATURE (°F.) | AGE TEMPERATURE (°F.) | AGE TIME (Minutes) |
|---|---|---|---|
| 2-B | 700 | 700 | 6 |
| 2-C | 700 | 700 | 8 |
| 2-D | 800 | 700 | 4 |
| 2-E | 800 | 700 | 6 |
| 2-F | 800 | 700 | 8 |
| 2-G | 800 | 800 | 3 |
| 2-H | 800 | 800 | 5 |
| 2-I | 800 | 800 | 7 |

TABLE V

| SAMPLE (1.73 to 1.79% Be) | PREAGE TEMPERATURE (°F.) | AGE TEMPERATURE (°F.) | AGE TIME (Minutes) |
|---|---|---|---|
| 2-J | 700 | 700 | 4 |
| 2-K | 700 | 700 | 6 |
| 2-L | 700 | 700 | 8 |
| 2-M | 800 | 700 | 4 |
| 2-N | 800 | 700 | 6 |
| 2-O | 800 | 700 | 8 |
| 2-P | 800 | 800 | 3 |
| 2-Q | 800 | 800 | 5 |
| 2-R | 800 | 800 | 7 |

The samples were tested for ultimate tensile strength, yield strength and elongation. The results are shown hereinbelow in Tables VI, VII, VIII and IX. Table VI is for the solution annealed samples. Tables VII, VIII and IX are respectively for the ¼ H, ½ H and H temper samples. All values are the average of two tests for each of two heats within the specified chemistries.

TABLE VI

| SAMPLE (A Temper) | UTS (ksi) | YS (ksi) | ELONGATION (%) |
|---|---|---|---|
| 2-A | 104.5 | 78.4 | 19.5 |
| 2-B | 128.4 | 102.1 | 16.5 |
| 2-C | 148.4 | 123.3 | 14.5 |
| 2-D | 108.8 | 82.3 | 19.5 |
| 2-E | 130.0 | 103.0 | 16.0 |
| 2-F | 146.0 | 119.8 | 14.0 |
| 2-G | 117.2 | 92.7 | 17.5 |
| 2-H | 124.6 | 103.0 | 16.0 |
| 2-I | 127.0 | 106.6 | 14.0 |
| 2-J | 88.2 | 61.1 | 22.0 |
| 2-K | 100.3 | 74.3 | 19.5 |
| 2-L | 109.9 | 84.1 | 15.3 |
| 2-M | 92.5 | 64.6 | 21.5 |
| 2-N | 101.2 | 75.3 | 18.5 |
| 2-O | 112.2 | 84.0 | 16.0 |
| 2-P | 102.3 | 73.9 | 19.0 |
| 2-Q | 108.6 | 79.7 | 20.5 |
| 2-R | 112.2 | 84.0 | 20.0 |

TABLE VII

| SAMPLE (¼ H Temper) | UTS (ksi) | YS (ksi) | ELONGATION (%) |
|---|---|---|---|
| 2-A | 153.0 | 133.6 | 10.0 |
| 2-B | 166.9 | 149.0 | 7.5 |
| 2-C | 171.6 | 152.9 | 7.5 |
| 2-D | 155.0 | 135.4 | 9.0 |
| 2-E | 165.0 | 146.1 | 9.0 |
| 2-F | 170.1 | 152.5 | 8.5 |
| 2-G | 148.9 | 128.0 | 10.0 |
| 2-H | 147.4 | 124.8 | 10.5 |
| 2-I | 146.0 | 124.5 | 10.5 |
| 2-J | 123.0 | 101.9 | 16.5 |
| 2-K | 138.9 | 118.3 | 13.5 |
| 2-L | 150.8 | 129.6 | 12.0 |
| 2-M | 126.5 | 105.3 | 14.5 |
| 2-N | 140.6 | 120.5 | 13.0 |

TABLE VII-continued

| SAMPLE (¼ H Temper) | UTS (ksi) | YS (ksi) | ELONGATION (%) |
|---|---|---|---|
| 2-O | 150.0 | 128.5 | 11.5 |
| 2-P | 132.5 | 111.3 | 12.5 |
| 2-Q | 136.1 | 112.5 | 12.0 |
| 2-R | 136.2 | 115.0 | 12.0 |

TABLE VIII

| SAMPLE (½ H Temper) | UTS (ksi) | YS (ksi) | ELONGATION (%) |
|---|---|---|---|
| 2-A | 146.6 | 128.2 | 12.0 |
| 2-B | 159.8 | 142.3 | 10.0 |
| 2-C | 166.9 | 149.3 | 8.0 |
| 2-D | 148.5 | 130.4 | 12.0 |
| 2-E | 157.7 | 138.2 | 11.0 |
| 2-F | 160.7 | 148.0 | 9.5 |
| 2-G | 144.6 | 123.9 | 11.5 |
| 2-H | 143.1 | 118.8 | 11.0 |
| 2-I | 142.4 | 118.8 | 11.5 |
| 2-J | 149.4 | 133.2 | 10.0 |
| 2-K | 160.2 | 144.0 | 9.0 |
| 2-L | 166.4 | 152.3 | 8.0 |
| 2-M | 151.0 | 133.6 | 10.5 |
| 2-N | 158.8 | 142.4 | 9.5 |
| 2-O | 163.4 | 145.7 | 8.0 |
| 2-P | 145.9 | 125.4 | 10.5 |
| 2-Q | 144.5 | 122.2 | 11.0 |
| 2-R | 143.9 | 121.5 | 11.5 |

TABLE IX

| SAMPLE (H Temper) | UTS (ksi) | YS (ksi) | ELONGATION (%) |
|---|---|---|---|
| 2-A | 181.6 | 162.6 | 4.0 |
| 2-B | 189.4 | 170.6 | 3.5 |
| 2-C | 190.9 | 170.6 | 4.0 |
| 2-D | 179.5 | 159.7 | 5.5 |
| 2-E | 184.4 | 165.3 | 4.0 |
| 2-F | 184.5 | 164.6 | 4.0 |
| 2-G | 163.8 | 141.0 | 7.5 |
| 2-H | 159.9 | 140.0 | 9.0 |
| 2-I | 158.3 | 134.6 | 9.0 |

A comparison of the data from Tables VI, VII, VIII and IX with that of established aging curves shows that the properties for the preaged and aged samples agree reasonably well with those for samples which were not preaged, regardless of whether the samples were preaged at 700° or 800° F. The short term preage of the subject invention does not materially detract from the aging characteristics of copper beryllium.

EXAMPLE III

Samples of copper beryllium alloy were melted, cast, hot rolled, solution annealed, preaged and aged. Some of the samples were cold rolled. They were in either the ¼ H, ½ H or H temper. The other samples were in the solution annealed (A) temper. The samples in the A temper had 1.88% beryllium and 0.22% cobalt. Their gauge was 0.0058 inch. The samples in the ¼ H temper had 1.86% beryllium and 0.28% cobalt. Their gauge was 0.0108 inch. The samples in the ½ H temper had 1.81% beryllium and 0.22% cobalt. Their gauge was 0.0083 inch. The samples in the H temper had 1.89% beryllium and 0.21% cobalt. Their gauge was 0.0056 inch. Samples for each temper were preaged and aged as shown hereinbelow in Table X.

TABLE X

| SAMPLE | PREAGE TEMPERATURE (°F.)/ TIME (Seconds) | AGE TEMPERATURE (°F.)/ TIME (Minutes) |
|---|---|---|
| 3-A | 600/30 | 600/120 |
| 3-B | 600/60 | 600/120 |
| 3-C | 700/30 | 600/120 |
| 3-D | 700/60 | 600/120 |
| 3-E | 800/30 | 600/120 |
| 3-F | 600/30 | 700/10 |
| 3-G | 600/60 | 700/10 |
| 3-H | 700/30 | 700/10 |
| 3-I | 700/60 | 700/10 |
| 3-J | 800/30 | 700/10 |

The samples were tested for ultimate tensile strength, yield strength and elongation in the longitudinal (direction of rolling) and transverse directions. The results are shown hereinbelow in Tables XI, XII, XIII and XIV. Table XI is for the solution annealed samples. Tables XII, XIII and XIV are respectively for the ¼ H, ½ H and H temper samples. All values are the average for two tests.

TABLE XI

| SAMPLE (A Temper) | DIRECTION | UTS (ksi) | YS (ksi) | ELONGATION (%) |
|---|---|---|---|---|
| 3-A | L | 173.1 | 142.5 | 4.5 |
| 3-B | L | 174.2 | 139.9 | 6.0 |
| 3-C | L | 176.0 | 141.5 | 5.5 |
| 3-D | L | 175.9 | 143.4 | 5.5 |
| 3-E | L | 171.5 | 139.1 | 5.0 |
| 3-A | T | 177.3 | 149.7 | 7.5 |
| 3-B | T | 174.3 | 145.9 | 7.0 |
| 3-C | T | 177.3 | 148.7 | 8.0 |
| 3-D | T | 175.7 | 149.8 | 7.5 |
| 3-E | T | 172.0 | 143.6 | 5.0 |
| 3-F | L | 150.1 | 113.8 | 9.0 |
| 3-G | L | 150.5 | 113.8 | 9.0 |
| 3-H | L | 153.5 | 115.1 | 9.0 |
| 3-I | L | 154.3 | 120.0 | 7.0 |
| 3-J* | L | 155.2 | 123.1 | 7.5 |
| 3-F | T | 150.5 | 123.7 | 10.5 |
| 3-G | T | 150.7 | 123.3 | 10.0 |
| 3-H | T | 152.2 | 125.3 | 10.5 |
| 3-I* | T | 161.3 | 137.9 | 9.0 |
| 3-J | T | 150.0 | 123.2 | 10.5 |

*AGE TIME IS ACTUALLY 13 MINUTES

TABLE XII

| SAMPLE (¼ H Temper) | DIRECTION | UTS (ksi) | YS (ksi) | ELONGATION (%) |
|---|---|---|---|---|
| 3-A | L | 183.0 | 157.5 | 4.0 |
| 3-B | L | 181.6 | 156.6 | 4.5 |
| 3-C | L | 183.1 | 159.6 | 4.0 |
| 3-D | L | 182.8 | 159.4 | 4.5 |
| 3-E | L | 179.6 | 154.5 | 5.0 |
| 3-A | T | 186.3 | 170.0 | 4.0 |
| 3-B | T | 186.7 | 169.6 | 4.0 |
| 3-C | T | 188.3 | 171.0 | 4.0 |
| 3-D | T | 189.1 | 174.2 | 4.0 |
| 3-E | T | 186.2 | 168.7 | 4.5 |
| 3-F | L | 167.8 | 143.7 | 5.5 |
| 3-G | L | 169.4 | 145.3 | 5.0 |
| 3-H | L | 169.9 | 145.7 | 6.5 |
| 3-I | L | 169.7 | 145.8 | 4.5 |
| 3-J* | L | 167.6 | 142.9 | 6.0 |
| 3-F | T | 174.3 | 159.9 | 5.5 |
| 3-G | T | 174.8 | 160.1 | 6.0 |
| 3-H* | T | 178.7 | 165.0 | 5.5 |
| 3-I* | T | 179.3 | 165.5 | 5.5 |
| 3-J | T | 169.8 | 158.1 | 7.5 |

*AGE TIME IS ACTUALLY 13 MINUTES

TABLE XIII

| SAMPLE (½ H Temper) | DIRECTION | UTS (ksi) | YS (ksi) | ELONGATION (%) |
|---|---|---|---|---|
| 3-A | L | 183.2 | 159.9 | 3.5 |
| 3-B | L | 183.3 | 159.8 | 3.5 |
| 3-C | L | 183.8 | 158.9 | 3.5 |
| 3-D | L | 182.5 | 158.1 | 3.0 |
| 3-E | L | 178.8 | 153.3 | 4.5 |
| 3-A | T | 194.5 | 181.0 | 3.0 |
| 3-B | T | 192.7 | 177.5 | 3.5 |
| 3-C | T | 193.0 | 178.7 | 3.5 |
| 3-D | T | 195.6 | 182.0 | 3.0 |
| 3-E | T | 190.0 | 175.9 | 3.0 |
| 3-F | L | 168.6 | 144.7 | 5.5 |
| 3-G | L | 167.8 | 143.0 | 5.0 |
| 3-H | L | 167.0 | 142.6 | 4.5 |
| 3-I* | L | 172.0 | 147.0 | 5.0 |
| 3-J | L | 165.2 | 138.9 | 5.0 |
| 3-F | T | 178.7 | 165.8 | 4.0 |
| 3-G | T | 178.6 | 166.3 | 4.0 |
| 3-H* | T | 183.5 | 171.0 | 4.0 |
| 3-I* | T | 182.5 | 170.4 | 3.5 |
| 3-J | T | 176.0 | 164.2 | 4.5 |

*AGE TIME IS ACTUALLY 13 MINUTES

TABLE XIV

| SAMPLE (H Temper) | DIRECTION | UTS (ksi) | YS (ksi) | ELONGATION (%) |
|---|---|---|---|---|
| 3-A | L | 194.3 | 165.9 | 2.0 |
| 3-B | L | 194.4 | 167.4 | 2.0 |
| 3-C | L | 191.0 | 164.5 | 2.0 |
| 3-D | L | 191.8 | 165.8 | 2.0 |
| 3-E | L | 182.0 | 153.6 | 2.5 |
| 3-A | T | 217.1 | 204.2 | 1.5 |
| 3-B | T | 214.5 | 200.6 | 1.5 |
| 3-C | T | 217.3 | 204.5 | 1.5 |
| 3-D | T | 214.4 | 201.6 | 2.0 |
| 3-E | T | 207.3 | 193.4 | 3.0 |
| 3-F | L | 182.8 | 154.8 | 2.0 |
| 3-G | L | 181.1 | 151.9 | 2.0 |
| 3-H* | L | 180.5 | 152.5 | 2.5 |
| 3-I | L | 179.6 | 151.5 | 2.0 |
| 3-J | L | 172.3 | 140.8 | 2.5 |
| 3-F | T | 204.9 | 191.4 | 2.0 |
| 3-G | T | 205.3 | 192.0 | 2.5 |
| 3-H* | T | 205.5 | 193.5 | 3.0 |
| 3-I* | T | 204.3 | 192.3 | 2.5 |
| 3-J | T | 197.3 | 184.1 | 4.0 |

*AGE TIME IS ACTUALLY 13 MINUTES

A comparison of the data from Tables, XI, XII, XIII and XIV with that of established aging curves shows that the properties for the preaged and aged samples agree reasonably well with those established for samples which were not preaged, regardless of whether the samples were preaged at 600°, 700° or 800° F. or for 30 or 60 seconds. The short term preage of the subject invention does not materially detract from the aging characteristics of copper beryllium. The 600° and 700° F. preaging had no significant affect on the properties of the material. The 800° F. preaging did not affect the material which was aged at 700° F. but did cause some lowering of properties after a 2 hour age at 600° F. This lowering of properties was, however, of minor significance.

EXAMPLE IV

Samples of copper beryllium alloy were melted, cast, hot rolled, solution annealed, cold rolled, formed over a 0.020 inch bend radius and aged. They were in either the ½ H or H temper. Those in the ½ H temper had 1.82% beryllium and 0.25% cobalt. Their gauge was 0.015. Those in the H temper had 1.81% beryllium and 0.25% cobalt. Their gauge was 0.008 inch. A 45° angle was formed on one side of the samples and a 120° angle was formed on the other side. The bend axes was transverse to the rolling direction. The samples were aged at 600°, 700° or 800° F. for times of 10, 60 and 240 seconds.

The angles were measured after aging to study the distortion which occured during aging. The results were unsatisfactory. The amount and direction of angular change (+ or −) was different for duplicate samples tested under the same conditions. The variation in angular change between duplicate samples run under the same conditions ranged from 0° to 11°. Such a variation is unaceptable in the production of parts.

EXAMPLE V

Samples of copper beryllium alloy were melted, cast, hot rolled, solution annealed, preaged, formed over a 0.020 inch bend radius and aged. Some of the samples were cold rolled. They were in either the ¼ H, ½ H or H temper. The other samples were in the solution annealed (A) temper. The samples had a beryllium content of from 1.73 to 1.89% and a cobalt content of from 0.19 to 0.24%. Their gauge was from 0.0049 to 0.0151 inch. There was a duplicate for each sample. A 45° angle was formed on one side of the samples and a 120° angle was formed on the other side. The bend axes was transverse to the rolling direction. Three preaging-bending-aging sequences were followed. They are as follows:

1. preage at 700° F. for 15 seconds, bend and age at 700° F. for 4, 6 or 8 minutes;
2. preage at 800° F. for 15 seconds, bend and age at 700° F. for 4, 6 or 8 minutes; and
3. preage at 800° F. for 15 seconds, bend and age at 800° F. for 3, 5 or 7 minutes.

The aging times were designed to produce ultimate tensile strength values of about 140 to 185 ksi.

The angles were measured after aging to study the distortion which occurred during aging. Distortion for the preaged samples was significantly less and more consistent than that for the samples of Example IV, which were not preaged.

The average change in the large angles for the 700° F./700° F. sequence were relatively small and were generally cosistent with respect to direction. The average change for the small angle using this sequence was less than that of the large angle, but was less consistent in direction. The largest individual angle change as 3° (1 sample out of 178). Eleven of the samples showed a 2° change.

Similarly good results were obtained for the 800° F./800° F. sequence as for the 700° F./700° F. sequence. No individual angle in this sequence changed more than 2°, and then only 20 out of 178 samples changed this amount.

Even better results were obtained for the 800° F./700° F. sequence than for either the 800° F./800° F. or 700° F./700° F. sequences. Only 7 out of 176 samples showed a 2° change. All the other samples changed from 0° to 1°. Two abnormally behaving samples were disregarded.

A comparison of double aging (Example V) with single aging (Example IV) clearly shows that the double aging process produces less overall distortion and generally more uniform distortion than the single aging process. Distortion for the preaged samples of this example was significantly less and more uniform than that for the samples of Example IV which were not preaged.

EXAMPLE VI

Samples of copper beryllium alloy were melted, cast, hot rolled, solution annealed, formed, and aged. Some of the samples were cold rolled. They were in either the ¼ H, ½ H or H temper. The other samples were in the solution annealed (A) temper. The samples had a beryllium content of from 1.73 to 1.88% and a cobalt content of from 0.19 to 0.23%. Their gauge was from 0.0060 to 0.0128 inch. A 90° angle was formed on each sample by bending them with a press brake having a 0.031 punch radius. The bend axes was transverse to the rolling direction. Half of the samples were preaged for 15 seconds at 800° F. and final aged after bending for 8 minutes at 700° F. The other half of the samples were bent with no preaging and final aged at 700° F. for 8 minutes.

The angle of each sample was measured after aging to study the distortion which occured during aging. The preaged samples showed considerably less distortion than did the samples which were not preaged.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

We claim:

1. In a process for producing formed parts from a copper beryllium alloy, which process includes the steps of: preparing a copper beryllium melt; casting the melt, hot working the cast copper beryllium; solution annealing the copper beryllium; optionally cold working the solution annealed copper beryllium; forming the copper beryllium; and age hardening the formed copper beryllium at a temperature of from 400° to 1200° F. for a period of at least 4 minutes; the improvement comprising the step of preaging the solution annealed or solution annealed and cold worked copper beryllium, prior to forming, at a temperature of from 400° to 1000° F. for a period of up to 180 seconds, the copper beryllium being at final gauge prior to preaging.

2. The process according to claim 1, wherein the preaging temperature is from 550° to 900° F.

3. The process according to claim 2, wherein the preaging temperature is from 650° to 850° F.

4. The process according to claim 1, wherein the copper beryllium is preaged for a period of up to 110 seconds.

5. The process according to claim 4, wherein the copper beryllium is preaged for a period of up to 90 seconds.

6. The process according to claim 5, wherein the preaging temperature is from 650° to 850° F.

7. A formed part of copper beryllium having from 0.2 to 3.0% beryllium, up to 3.5% of material from the group consisting of cobalt and nickel, and at least 90% copper and made in accordance with the process of claim 1.

* * * * *